US011322877B2

(12) United States Patent
Chang et al.

(10) Patent No.: US 11,322,877 B2
(45) Date of Patent: May 3, 2022

(54) ELECTRICAL PLUG CONNECTOR

(71) Applicant: ADVANCED-CONNECTEK INC., New Taipei (TW)

(72) Inventors: Ming-Yung Chang, New Taipei (TW); Mao-Sheng Chen, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 17/025,464

(22) Filed: Sep. 18, 2020

(65) Prior Publication Data

US 2021/0091500 A1 Mar. 25, 2021

Related U.S. Application Data

(60) Provisional application No. 62/902,687, filed on Sep. 19, 2019.

(51) Int. Cl.

| | |
|---|---|
| ***H01R 13/424*** | (2006.01) |
| ***H01R 24/60*** | (2011.01) |
| ***H01R 13/506*** | (2006.01) |
| ***H01R 13/405*** | (2006.01) |
| ***H01R 13/26*** | (2006.01) |
| ***H01R 13/42*** | (2006.01) |
| ***H01R 13/627*** | (2006.01) |
| ***H01R 13/629*** | (2006.01) |
| ***H01R 13/6583*** | (2011.01) |
| ***H01R 13/11*** | (2006.01) |
| ***H01R 107/00*** | (2006.01) |

(52) U.S. Cl.

CPC ..... *H01R 13/424* (2013.01); *H01R 13/11* (2013.01); *H01R 13/26* (2013.01); *H01R 13/405* (2013.01); *H01R 13/42* (2013.01); *H01R 13/506* (2013.01); *H01R 13/629* (2013.01); *H01R 13/6271* (2013.01); *H01R 13/6583* (2013.01); *H01R 24/60* (2013.01); *H01R 2107/00* (2013.01)

(58) Field of Classification Search

None

See application file for complete search history.

(56) References Cited

U.S. PATENT DOCUMENTS 9,705,268 B1 * 7/2017 Yuan ..... H01R 13/6616
9,799,966 B2 * 10/2017 Tsai ..... H01R 13/6581

(Continued)

*Primary Examiner* — Oscar C Jimenez

(74) *Attorney, Agent, or Firm* — Muncy, Geissler, Olds & Lowe, PC

(57) ABSTRACT

An electrical plug connector includes a metallic shell, an insulated housing, a power terminal group, and a signal terminal group received in the metallic shell. Each terminal of the power terminal group includes a first contact portion, a second contact portion, and a positioning plate that are formed as a clamp structure. The first contact portion extends from an upper portion of the positioning plate and is above the insertion cavity of the insulated housing. The second contact portion extends from a lower portion of the positioning plate and is below the insertion cavity of the insulated housing. Each terminal of the signal terminal group is side-by-side arranged with the corresponding terminal of the power terminal group. A cross-sectional area of each terminal of the signal terminal group is less than a cross-sectional area of the corresponding terminal of the power terminal group.

18 Claims, 12 Drawing Sheets

(56) References Cited

U.S. PATENT DOCUMENTS

| | | | | |
|---|---|---|---|---|
| 2010/0216340 | A1* | 8/2010 | Lin | H01R 13/6485 439/607.01 |
| 2018/0145449 | A1* | 5/2018 | Wei | H01R 24/60 |
| 2018/0145458 | A1* | 5/2018 | Wei | H01R 13/6273 |

* cited by examiner

ELECTRICAL PLUG CONNECTOR

CROSS-REFERENCE TO RELATED APPLICATION

This non-provisional application claims priority under 35 U.S.C. § 119(e) to U.S. Provisional Patent Application No. 62/902,687, filed on Sep. 19, 2019, the entire contents of which are hereby incorporated by reference.

FIELD OF THE INVENTION

The instant disclosure relates to an electrical connector, and more particular to an electrical plug connector.

BACKGROUND

The appearance, the structure, the contact ways of terminals, the number of terminals, the pitches between terminals (the distances between the terminals), and the pin assignment of terminals of a USB type-C electrical connector known to the inventor(s) are totally different from those of a USB electrical connector known to the inventor(s).

A USB type-C electrical receptacle connector known to the inventor(s) includes a plastic core, upper and lower plug terminals held on the plastic core, an outer iron shell circularly enclosing the plastic core, hook structures at two sides of the interior of the insertion cavity of the plastic core.

SUMMARY OF THE INVENTION

The upper plug terminals and the lower plug terminals are both bent-type terminals, or the upper plug terminals and the lower plug terminals are both blanking-type terminals. The cross-sectional area of the bent-type terminal is less than the cross-sectional area of the blanking-type terminal. It is understood that, the electrical connector with the bent-type terminals meets the Gen2 specification but is not applicable for transmitting a current having 6 Amps or more. Conversely, since the blanking-type terminal has a greater cross-sectional area, the electrical connector with the blanking-type terminals is applicable for transmitting a current having 6 Amps or more, thereby the electrical connector with the blanking-type terminals having a greater charging speed as compared with the charging speed of the electrical connector with the bent-type terminals. Nevertheless, the electrical connector with the blanking-type terminals does not meet the Gen2 specification.

In view of these, one embodiment of the instant disclosure provides an electrical plug connector. The electrical plug connector comprises a metallic shell, an insulated housing, a power terminal group, and a signal terminal group. The insulated housing is in the metallic shell. One of two ends of the insulated housing comprises an insertion cavity, and the other end of the insulated housing comprises a plurality of terminal grooves communicating with the insertion cavity. The power terminal group is in the terminal grooves. Each terminal of the power terminal group comprises a first contact portion, a second contact portion, and a positioning plate. The first contact portion, the second contact portion, and the positioning plate are formed as a clamp structure. The first contact portion extends from an upper portion of the positioning plate and is above the insertion cavity. The second contact portion extends from a lower portion of the positioning plate and is below the insertion cavity. Each of the terminals of the power terminal group comprises a contact point at one side of the positioning plate, and the contact point is in contact with an inner wall of the corresponding terminal groove. The signal terminal group is in the terminal grooves. Each terminal of the signal terminal group is arranged with the corresponding terminal of the power terminal group side-by-side. A cross-sectional area of each of the terminals of the signal terminal group is less than a cross-sectional area of the corresponding terminal of the power terminal group.

In one or some embodiments, each of the terminals of the power terminal group is a blanking-type terminal, and each of the terminals of the signal terminal group is a bent-type terminal.

In one or some embodiments, each of the terminals of the power terminal group comprises a plurality of the contact points at two sides of the positioning plate, and each of the contact points is in contact with the inner wall of the corresponding terminal groove.

In one or some embodiments, each of the terminals of the power terminal group comprises a first tail portion and a second tail portion, the first tail portion extends out of the corresponding terminal groove from the upper portion of the positioning plate, and the second tail portion extends out of the corresponding terminal groove from the lower portion of the positioning plate.

In one or some embodiments, the insulated housing comprises stopping blocks respectively formed in the terminal grooves, and each of the stopping blocks is between the first contact portion and the second contact portion of the corresponding terminal of the power terminal group.

In one or some embodiments, the electrical plug connector further comprises a positioning block, wherein the positioning block is assembled with the signal terminal group, and the positioning block is abutted against a rear portion of the positioning plate of one of the terminals of the power terminal group.

In one or some embodiments, an engaging block protrudes from the positioning block, and the engaging block is engaged with an inner side of the insulated housing.

In one or some embodiments, the electrical plug connector further comprises a plurality of hook portions at two sides of the insulated housing and extending into the insertion cavity, wherein the hook portion is a blanking-type hook or a bent-type hook. In the case that the hook portions comprise blanking-type hooks, a lateral arm is between the blanking-type hooks.

In one or some embodiments, the terminals of the signal terminal group are arranged into two rows, the signal terminal group comprises a plurality of high-speed signal terminals and a plurality of low-speed signal terminals.

According to one or some embodiments of the instant disclosure, the terminals of the power terminal group and the terminals of the signal terminal group are formed as terminals in different types. The power terminal group and the signal terminal group are provided in the same electrical plug connector, such that the electrical plug connector is applicable for transmitting a current having 6 Amps or more and meets the Gen2 specification.

The thicknesses for different portions of the terminal of the signal terminal group are approximately the same, thereby being suitable for high-speed signal transmission and high frequency characteristics adjustment. The thicknesses for different portions of the terminal of the power terminal group are not the same, and the thickness of the terminal of power terminal group is gradually reduced (the terminal of the power terminal group may have a wider thickness for the second tail portion but have a reduced width for the second contact portion, but embodiments are not limited thereto). The signal terminal group uses the bent-type terminals for meeting the Gen2 specification, and the signal terminal group is served as terminals for signal transmission. The power terminal group uses the blanking-type terminals, and the power terminal group is served as terminals for power transmission. The cross-sectional area of the blanking-type terminal is greater than the cross-sectional area of the bent-type terminal thereby suitable for transmitting a current having 6 Amps or more. The blanking-type terminal has a greater charging speed as compared with the charging speed of the bent-type terminal.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
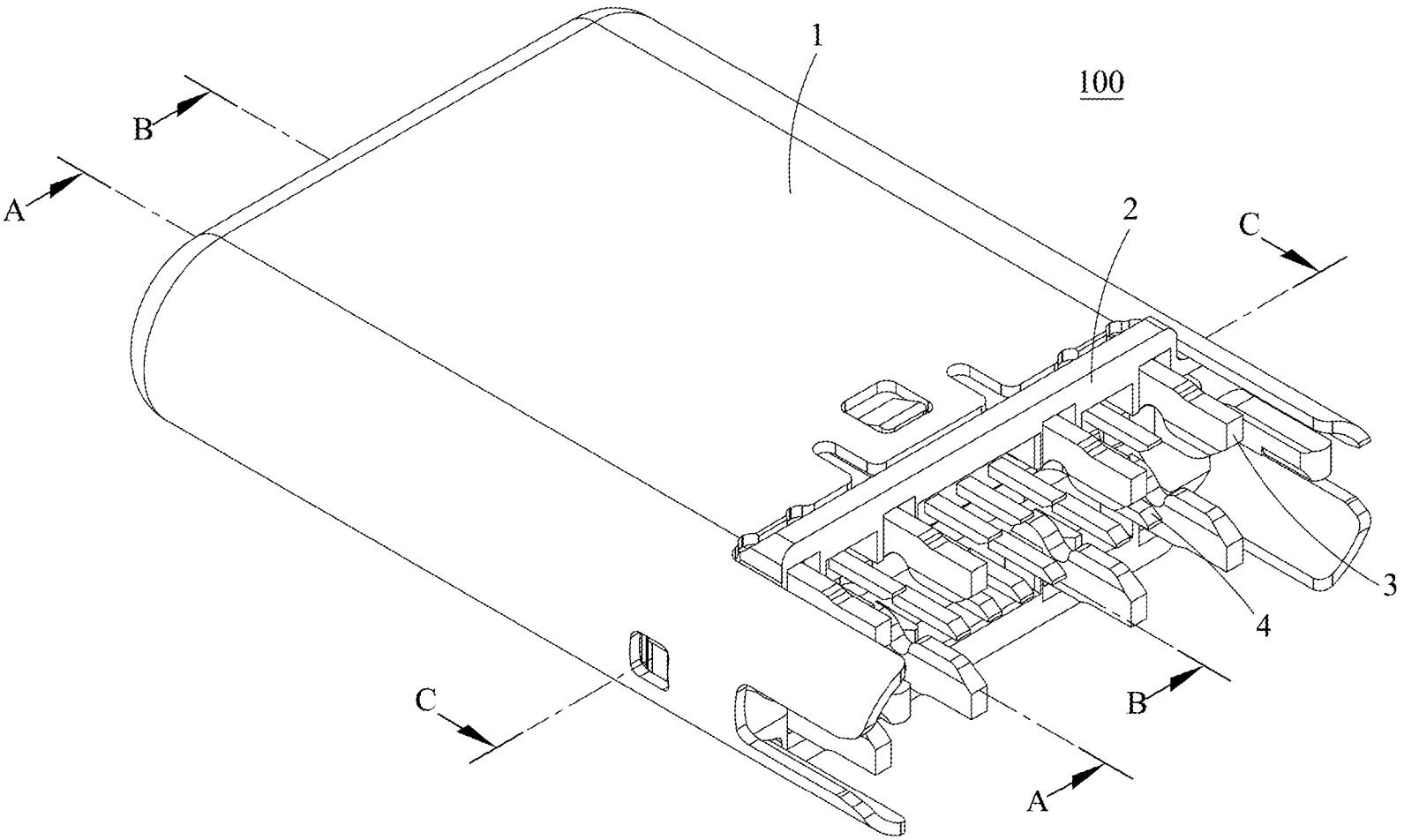
FIG. 1 illustrates a perspective view of an electrical plug connector according to a first embodiment of the instant disclosure.
Figure 2:
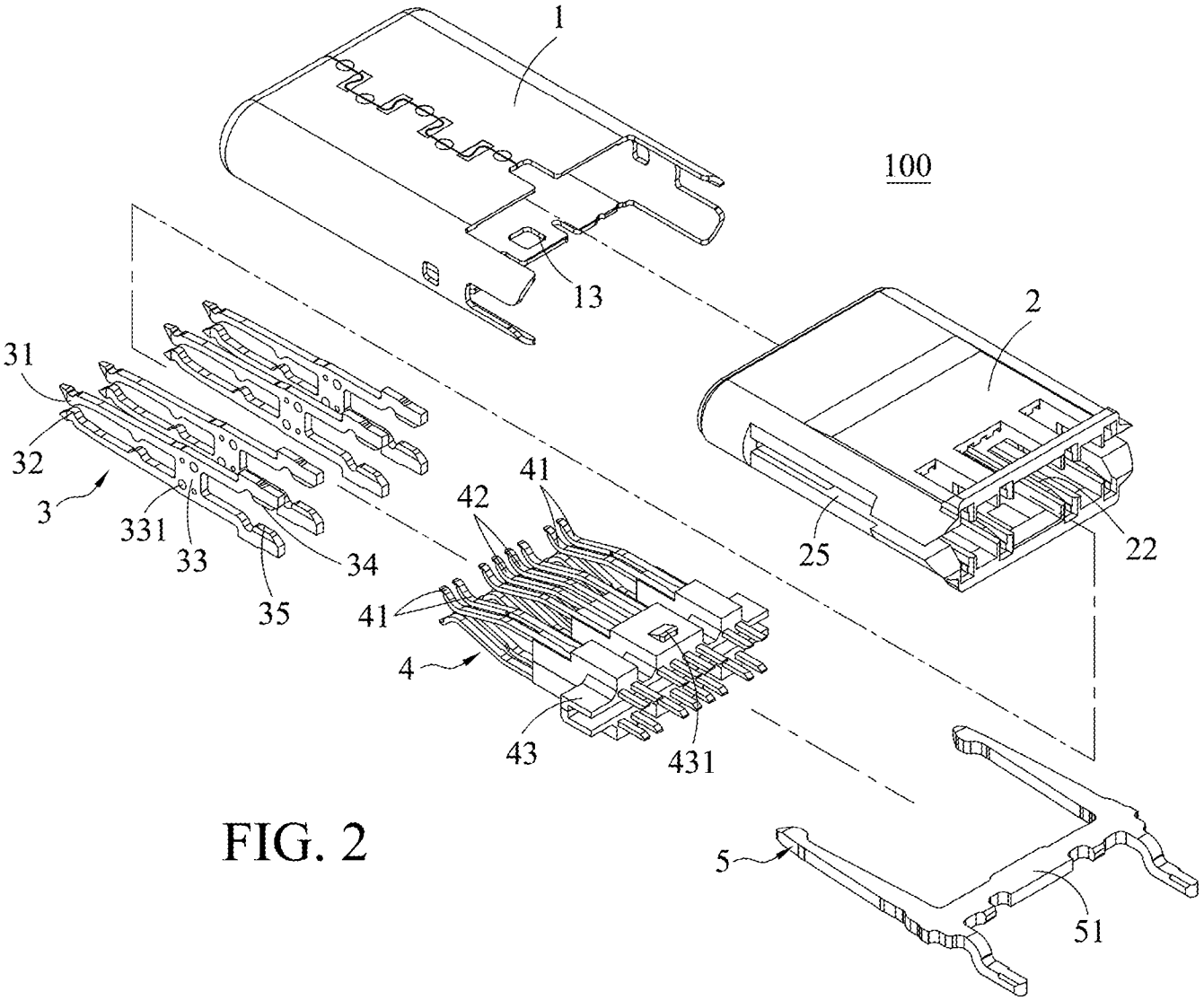
FIG. 2 illustrates an exploded view of the electrical plug connector of the first embodiment.

Please refer to FIGS. 1 and 2. An electrical plug connector 100 according to a first embodiment of the instant disclosure is illustrated. FIG. 1 illustrates a perspective view of the electrical plug connector 100 of the first embodiment. FIG. 2 illustrates an exploded view of the electrical plug connector 100 of the first embodiment. In this embodiment, the electrical plug connector 100 comprises a metallic shell 1, an insulated housing 2, a power terminal group 3, and a signal terminal group 4.

Figure 3:
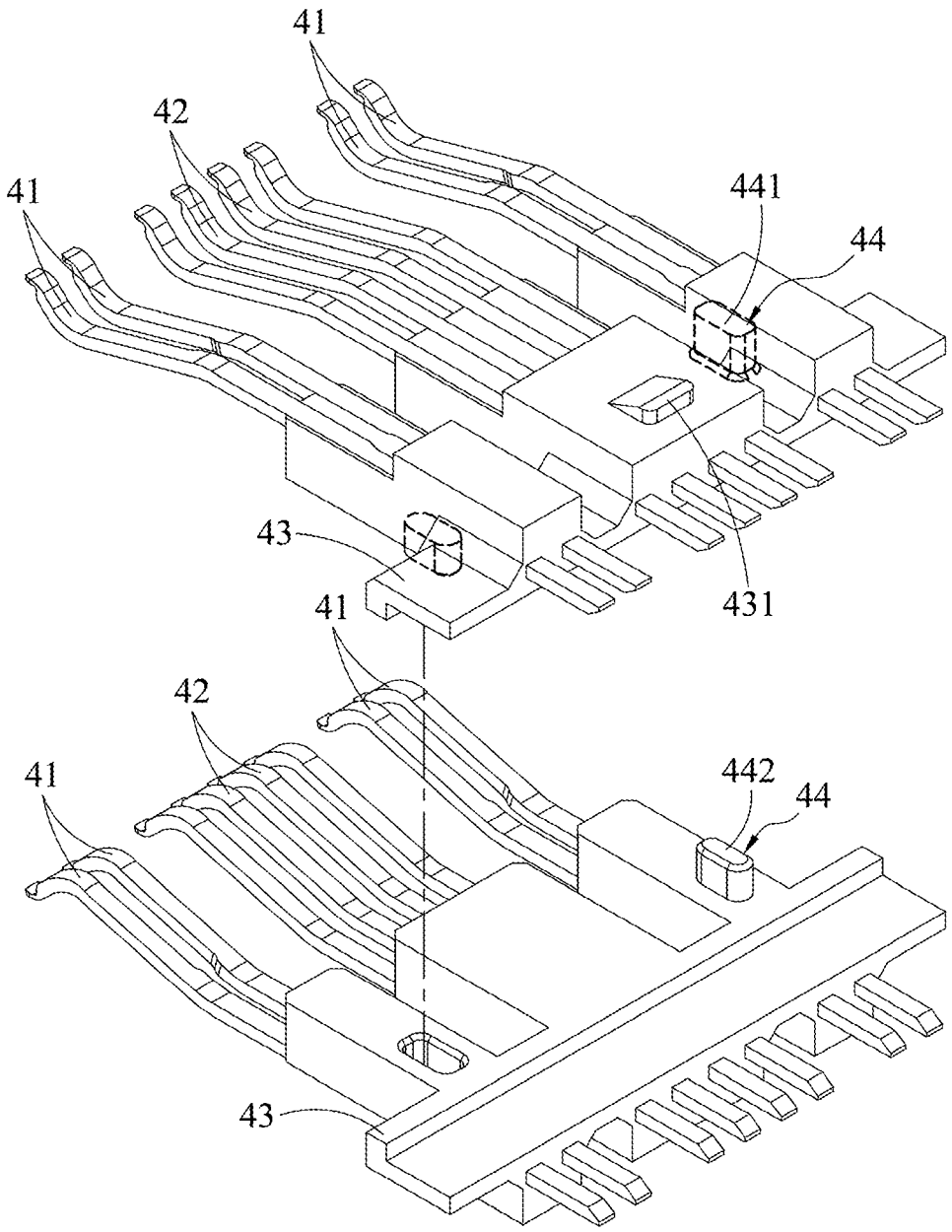
FIG. 3 illustrates an exploded of the signal terminal group of the electrical plug connector of the first embodiment.
Figure 4:
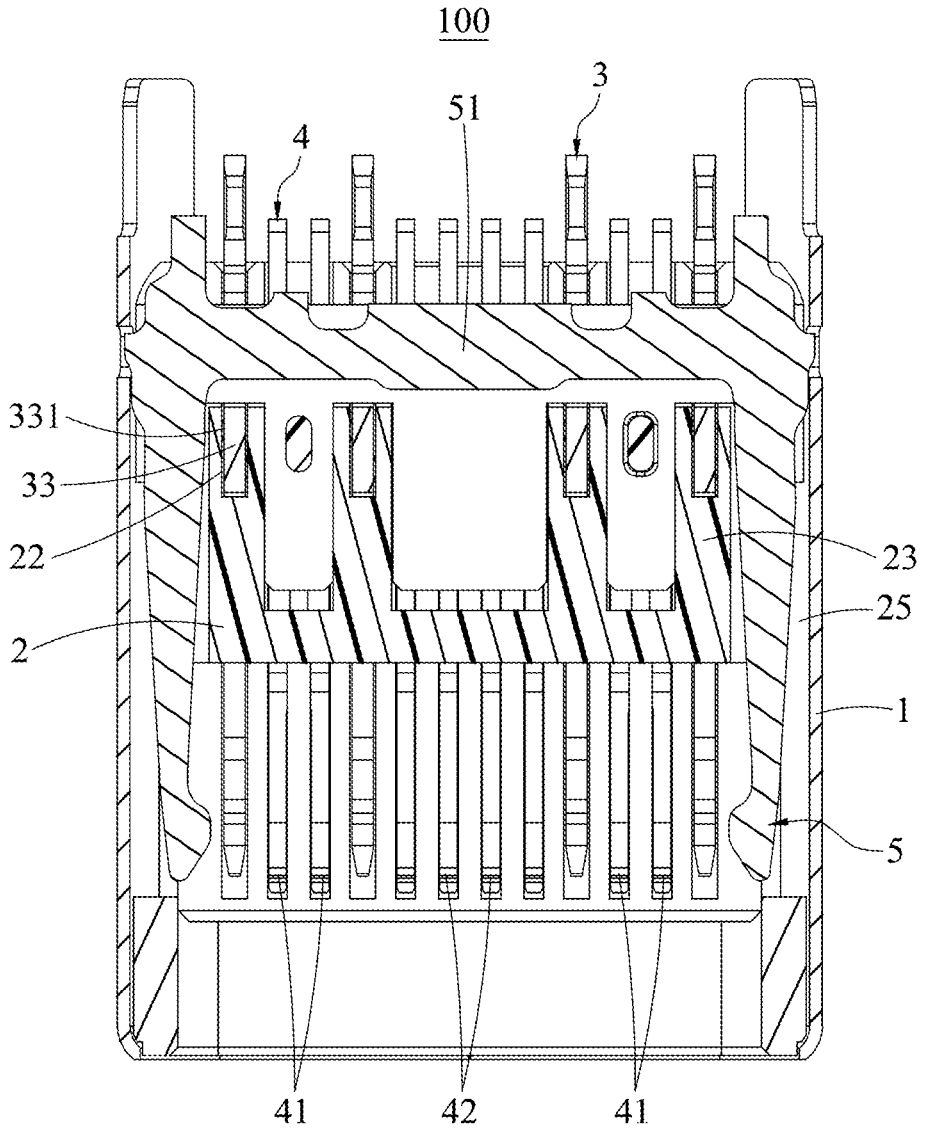
FIG. 4 illustrates a top sectional view of the electrical plug connector of the first embodiment.
Figure 5:
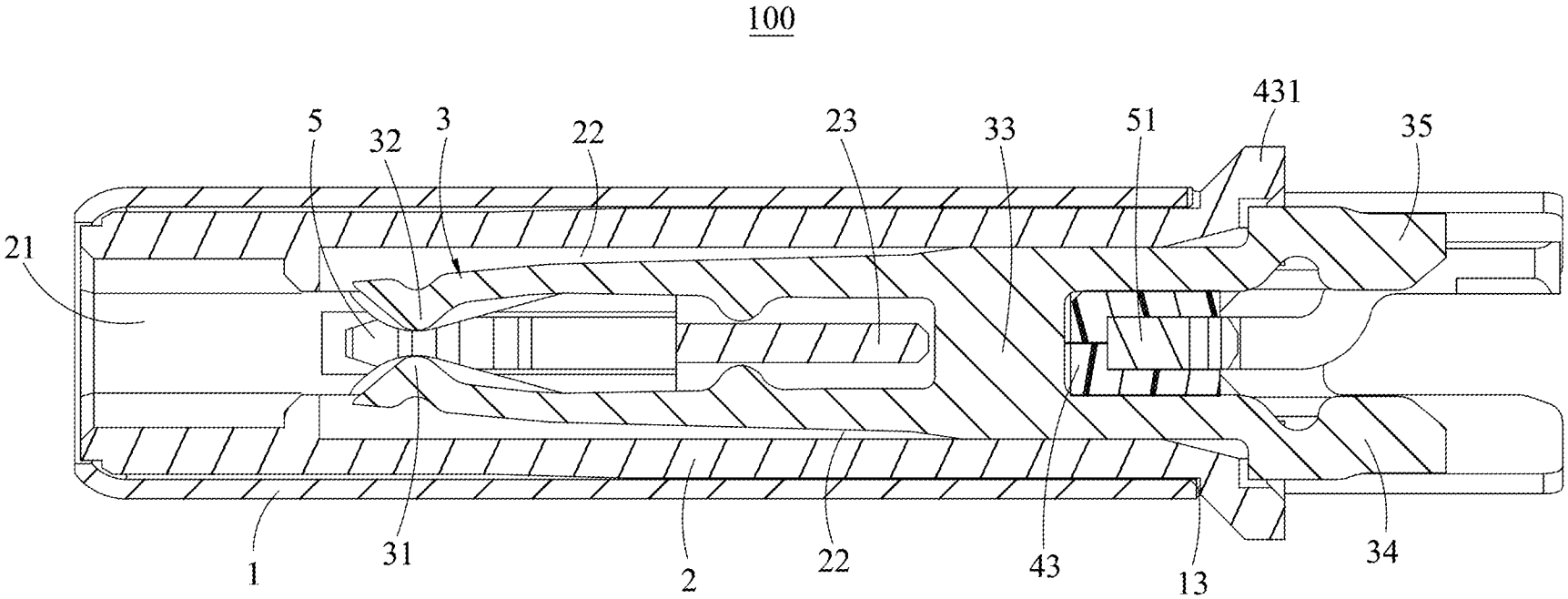
FIG. 5 illustrates a cross-sectional view along line AA shown in FIG. 1.
Figure 6:
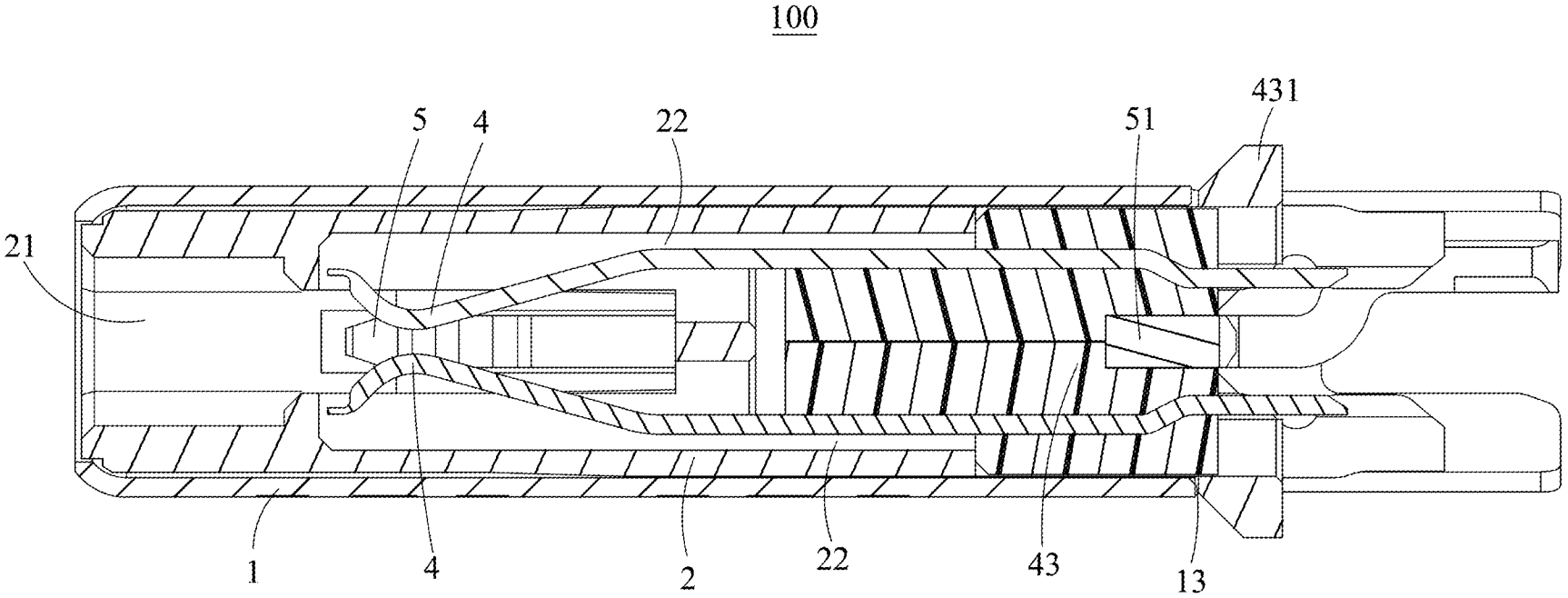
FIG. 6 illustrates a cross-sectional view along line BB shown in FIG. 1.
Figure 7:
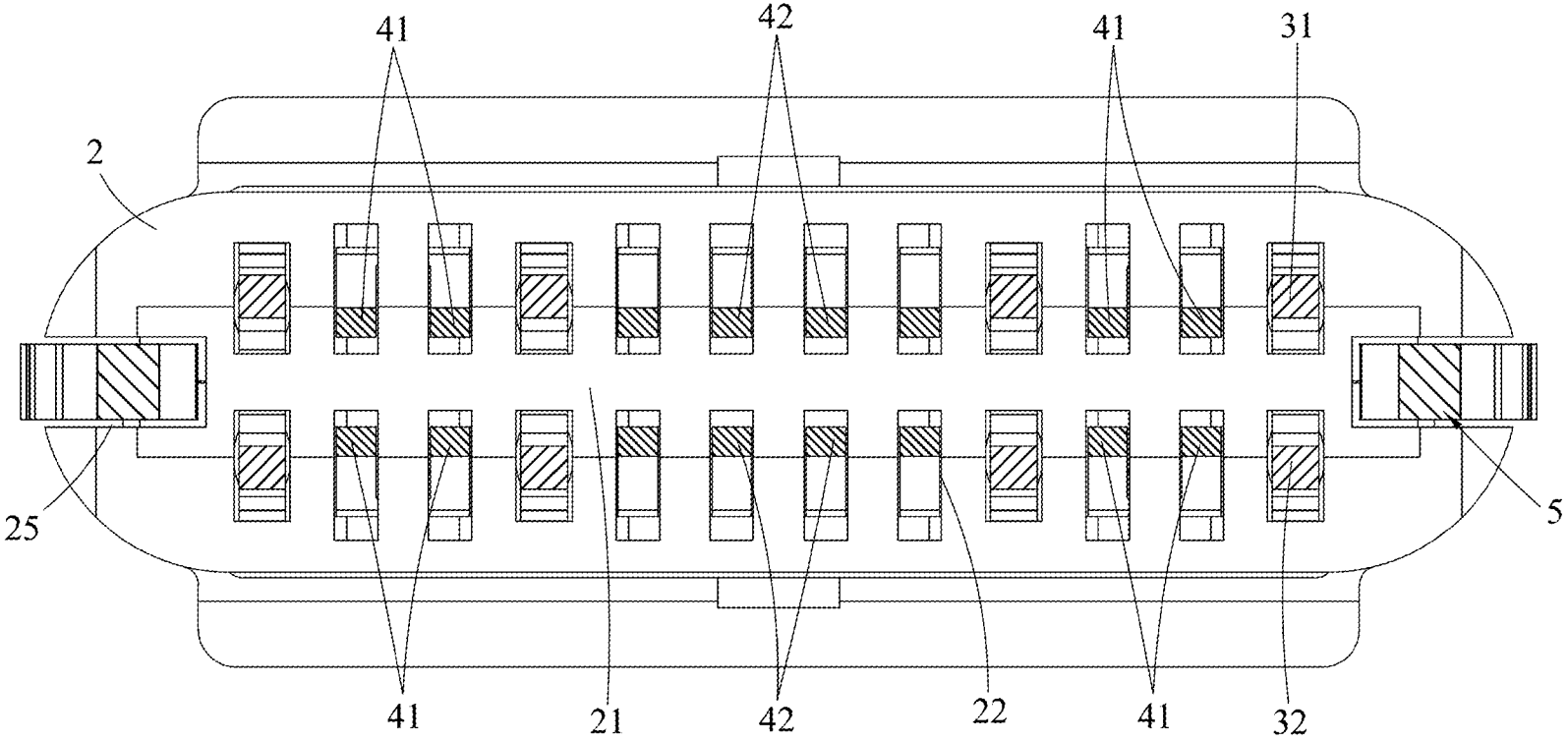
FIG. 7 illustrates a cross-sectional view along line CC shown in FIG. 1.

Please refer to FIGS. 1 to 7. FIG. 3 illustrates an exploded view of the signal terminal group of the electrical plug connector of the first embodiment. FIG. 4 illustrates a top sectional view of the electrical plug connector of the first embodiment. FIG. 5 illustrates a cross-sectional view along line AA shown in FIG. 1. FIG. 6 illustrates a cross-sectional view along line BB shown in FIG. 1. FIG. 7 illustrates a cross-sectional view along line CC shown in FIG. 1.

In this embodiment, the insulated housing 2 is received in the metallic shell 1. One of two ends of the insulated housing 2 in a longitudinal direction comprises an insertion cavity 21, and the other end of the insulated housing 2 comprises a plurality of terminal grooves 22 communicating with the insertion cavity 21.

In this embodiment, the power terminal group 3 is retained in the terminal grooves 22. Each terminal of the power terminal group 3 comprises a first contact portion 31, a second contact portion 32, and a positioning plate 33 integrally formed as a one-piece member. The first contact portion 31, the second contact portion 32, and the positioning plate 33 are formed as a clamp structure, as the clamp structure with a left-opened opening shown in FIG. 5. The first contact portion 31 extends from an upper portion of the positioning plate 33 and is above the insertion cavity 21. The second contact portion 32 extends from a lower portion of the positioning plate 33 and is below the insertion cavity 21. The first contact portion 31 and the second contact portion 32 may have a mirror symmetry configuration, or the first contact portion 31 and the second contact portion 32 may have an asymmetry configuration.

In this embodiment, the signal terminal group 4 is retained in the terminal grooves 22, and each terminal of the signal terminal group 4 is arranged with the corresponding terminal of the power terminal group 3 side-by-side in a transverse direction perpendicular to the longitudinal direction. A cross-sectional area of each of the terminals of the signal terminal group 4 is less than a cross-sectional area of each of the terminals of the power terminal group 3, as shown in FIG. 7 (for example, a cross-sectional area of the high-speed signal terminal 41 is less than a cross-sectional area of the first contact portion 31). FIG. 7 illustrates a schematic view showing the cross section of the orthographic projection of the electrical plug connector 100 along the line CC in FIG. 1, and the orthographic projection is a projection that is perpendicular to the central axis of the electrical plug connector 100. In this embodiment, it is understood that the electrical plug connector 100 is sectioned at the portion having the line CC in FIG. 1 for illustrating the cross-section relationship, but embodiments are not limited thereto. In some embodiments, the electrical plug connector 100 may be sectioned at any portions, and the cross-sectional area of the terminal of the signal terminal group 4 is also less than the cross-sectional area of the terminal of the power terminal group 3.

In this embodiment, more specifically, each of the terminals of the power terminal group 3 is a blanking-type terminal, and each of the terminals of the signal terminal group 4 is a bent-type terminal. In this embodiment, the power terminal group 3 is a terminal structure manufactured by blanking techniques, thereby having enhanced structural strengths, and the signal terminal group 4 is manufactured by stamping techniques so as to be bent. The structural strength of the blanking-type terminal is greater than the structural strength of the bent-type terminal.

In this embodiment, more specifically, each of the terminals of the power terminal group 3 comprises a plurality of contact points 331 at two sides of the positioning plate 33 in the transverse direction. The contact points 331 are in contact with an inner wall of the corresponding terminal groove 22 (as shown in FIGS. 2 and 4). In this embodiment, the contact points 331 may be round protrusions, but not limited thereto. The contact points 331 may be other protruding structures or may be structures with concave/convex profiles. The contact points 331 are provided for contacting the inner wall of the corresponding terminal groove 22. In some embodiments, each of the terminals of the power terminal group 3 comprises a contact point 331 at one side of the positioning plate 33. As shown in FIG. 2, the terminal of the power terminal group 3 comprises one contact point 331 in contact with the inner wall of the corresponding terminal groove 22.

In this embodiment, more specifically, each of the terminals of the power terminal group 3 comprises a first tail portion 34 and a second tail portion 35. The first tail portion 34 extends out of the corresponding terminal groove 22 from the upper portion of the positioning plate 33, and the second tail portion 35 extends out of the corresponding terminal groove 22 from the lower portion of the positioning plate 33. In this embodiment, the first contact portion 31, the second contact portion 32, the positioning plate 33, the first tail portion 34, and the second tail portion 35 are formed as an H-shape structure. Specifically, in this embodiment, the first tail portion 34 and the second tail portion 35 are respectively at an upper surface and a lower surface of a circuit board, and the first tail portion 34 and the second tail portion 35 are electrically connected to contacts on the circuit board.

In this embodiment, more specifically, the insulated housing 2 comprises stopping blocks 23 respectively formed in the terminal grooves 22, and each of the stopping blocks 23 is abutted against a front portion of the corresponding positioning plate 33. In this embodiment, each of the stopping blocks 23 is between the first contact portion 31 and the second contact portion 32 of the corresponding terminal of the power terminal group 3.

In this embodiment, more specifically, the electrical plug connector 100 further comprises a positioning block 43 assembled with the signal terminal group 4. In this embodiment, the positioning block 43 and the signal terminal group 4 are assembled with each other by insert-molding techniques.

In this embodiment, more specifically, the electrical plug connector 100 comprises a plurality of the positioning blocks 43 respectively formed with upper-row terminals of the signal terminal group 4 and lower-row terminals of the signal terminal group 4 (as shown in FIG. 3), and the positioning block 43 of the upper-row terminals of the signal terminal group 4 are correspondingly assembled with the positioning block 43 of the lower-row terminals of the signal terminal group 4 through the engaging structures 44 (e.g., the slots 441 and the protrusions 442) on the surfaces of the positioning blocks 43, but embodiments are not limited thereto. In some embodiments, the electrical plug connector 100 may have one positioning block 43 formed with the signal terminal group 4.

Figure 10:
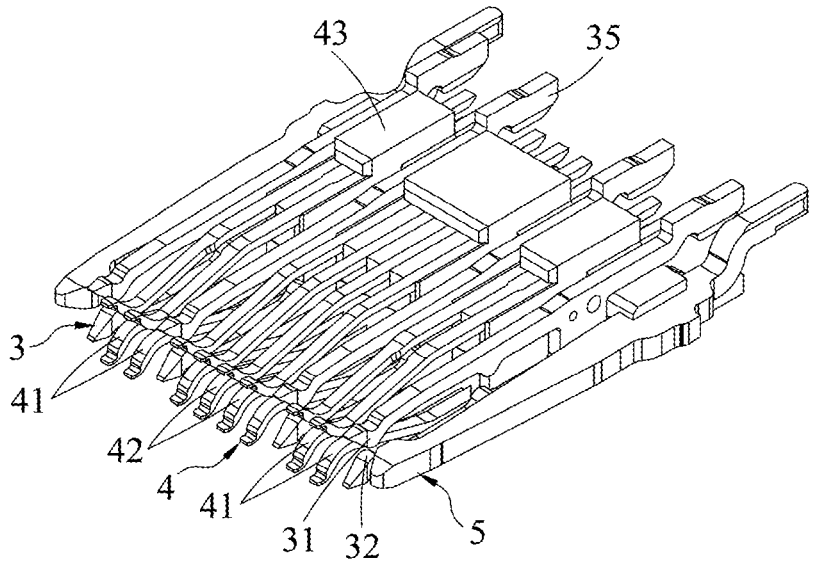
FIG. 10 illustrates an assembled perspective view (1) showing the power terminal group and the signal terminal group of the electrical plug connector of some exemplary embodiments.
Figure 11:
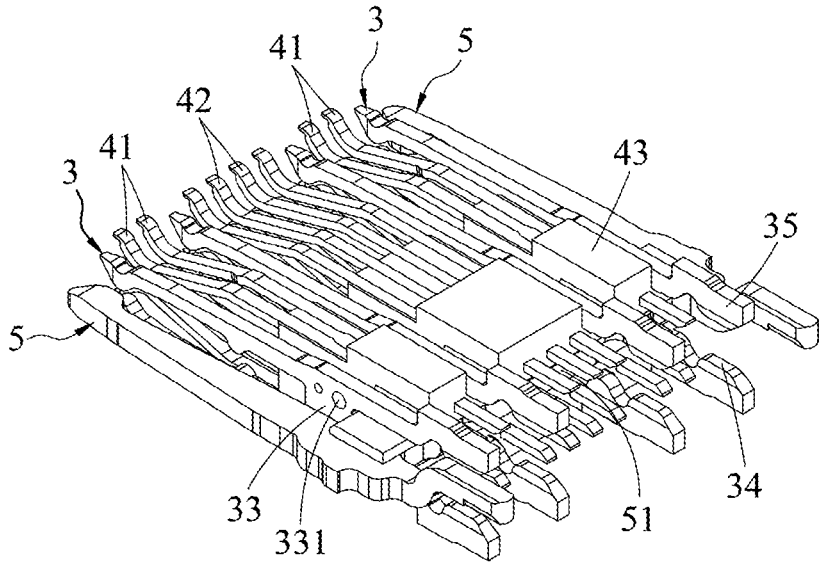
FIG. 11 illustrates an assembled perspective view (2) showing the power terminal group and the signal terminal group of the electrical plug connector of some exemplary embodiments.

In this embodiment, more specifically, the positioning block 43 is abutted against a rear portion of the positioning plate 33 of one of the terminals of the power terminal group 3 (as shown in FIGS. 4, 10, and 11). In this embodiment, the positioning block 43 is engaged between the first tail portion 34 and the second tail portion 35 of one of the terminals of the power terminal group 3. In this embodiment, since the positioning block 43 is abutted against the rear portion of the positioning plate 33, the power terminal group 3 can be prevented from detaching off the terminal grooves 22 when the electrical plug connector 100 is mated with a mating electrical receptacle connector.

In this embodiment, more specifically, an engaging block 431 protrudes from the positioning block 43. The engaging block 431 is engaged with an inner side of the insulated housing 2, thereby providing a positioning function after the positioning block 43 is assembled with the insulated housing 2. Moreover, the engaging block 431 may be further engaged into a buckling hole 13 of the metallic shell 1.

In this embodiment, more specifically, the electrical plug connector 100 further comprises a plurality of hook portions 5. The hook portions 5 are at two sides of the insulated housing 2, and a front end of each of the hook portions 5 extends into the insertion cavity 21. In this embodiment, the hook portions 5 are blanking-type hooks, but embodiments are not limited thereto. In the case that the hook portions 5 comprise blanking-type hooks, a lateral arm 51 is between the blanking-type hooks and integrally formed with the blanking-type hooks. The lateral arm 51 is positioned in the groove of the positioning block 43. In this embodiment, since the lateral arm 51 is positioned in the groove of the positioning block 43, the lateral arm 51 and the tail portions of each of the terminals of the signal terminal group 4 is spaced by a distance. Accordingly, the lateral arm 51 is not in contact with the tail portion of each of the terminals of the signal terminal group 4, thereby preventing a short circuit connection.

In this embodiment, more specifically, assembling portions 25 are at two sides of the insulated housing 2. The assembling portions 25 are formed as cut grooves and are at the two sides of the insulated housing 2. A front end of the assembling portion 25 extends toward and in communication with the insertion cavity 21. The hook portions 5 are respectively held with the assembling portions 25. It is understood that the assembling portion 25 is not limited to have the cut groove configuration. Please refer to FIG. 12, in some embodiments, the assembling portions 25 may be closed grooves and at the two sides of the insulated housing 2, and the hook portions 5 are respectively held with the assembling portions 25.

In this embodiment, more specifically, the terminals of the signal terminal group 4 are arranged into two rows. As shown in FIGS. 2 and 3, the terminals of the signal terminal group 4 are arranged as stacked upper-row terminals and lower-row terminals. The upper-row terminals and the lower-row terminals of the signal terminal group 4 may have a mirror symmetry configuration, or the upper-row terminals and the lower-row terminals of the signal terminal group 4 may have an asymmetry configuration. In this embodiment, the signal terminal group 4 comprises a plurality of high-speed signal terminals 41 and a plurality of low-speed signal terminals 42.

Figure 8:
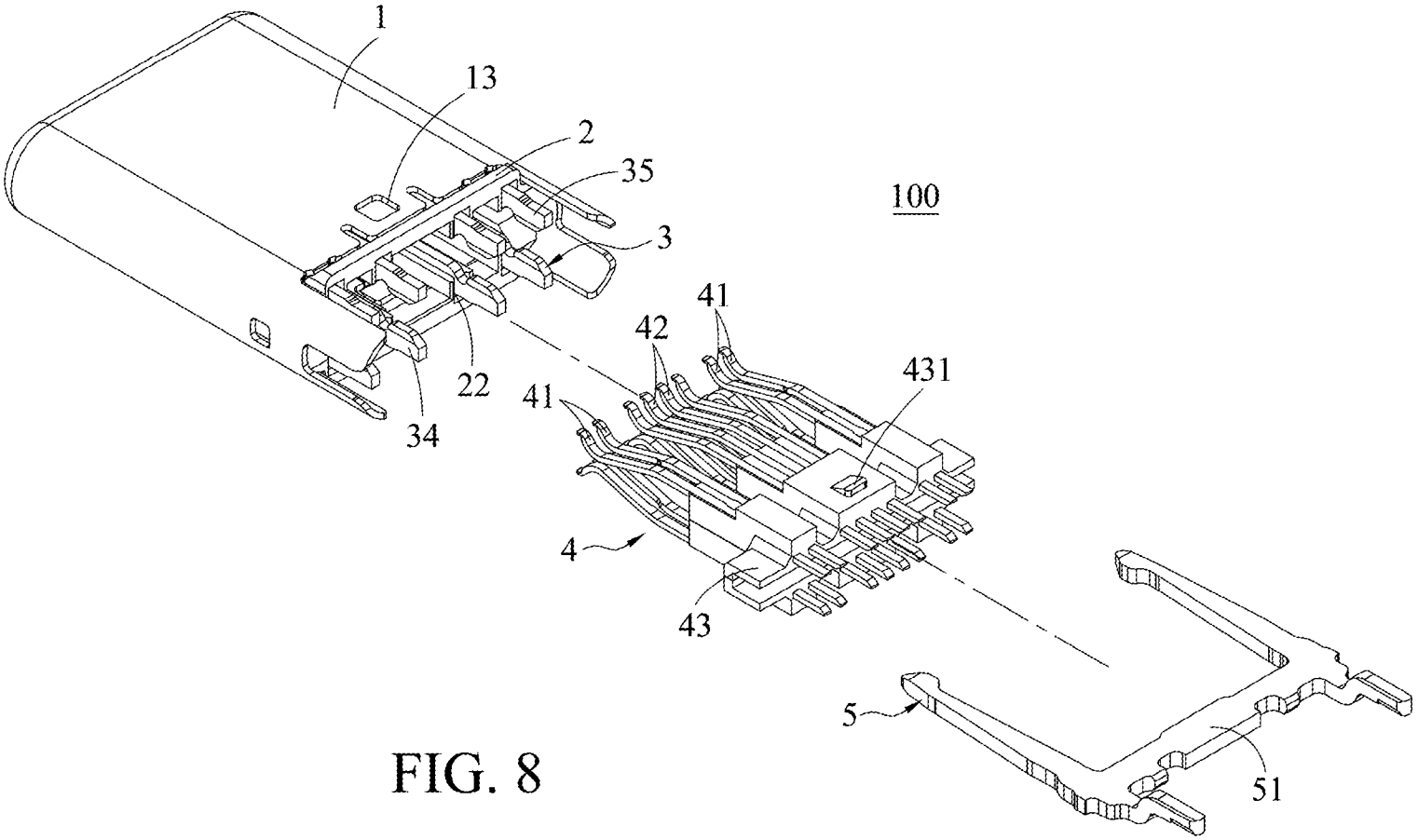
FIG. 8 illustrates an assembled perspective view (1) of an electrical plug connector according to some exemplary embodiments of the instant disclosure.
Figure 9:
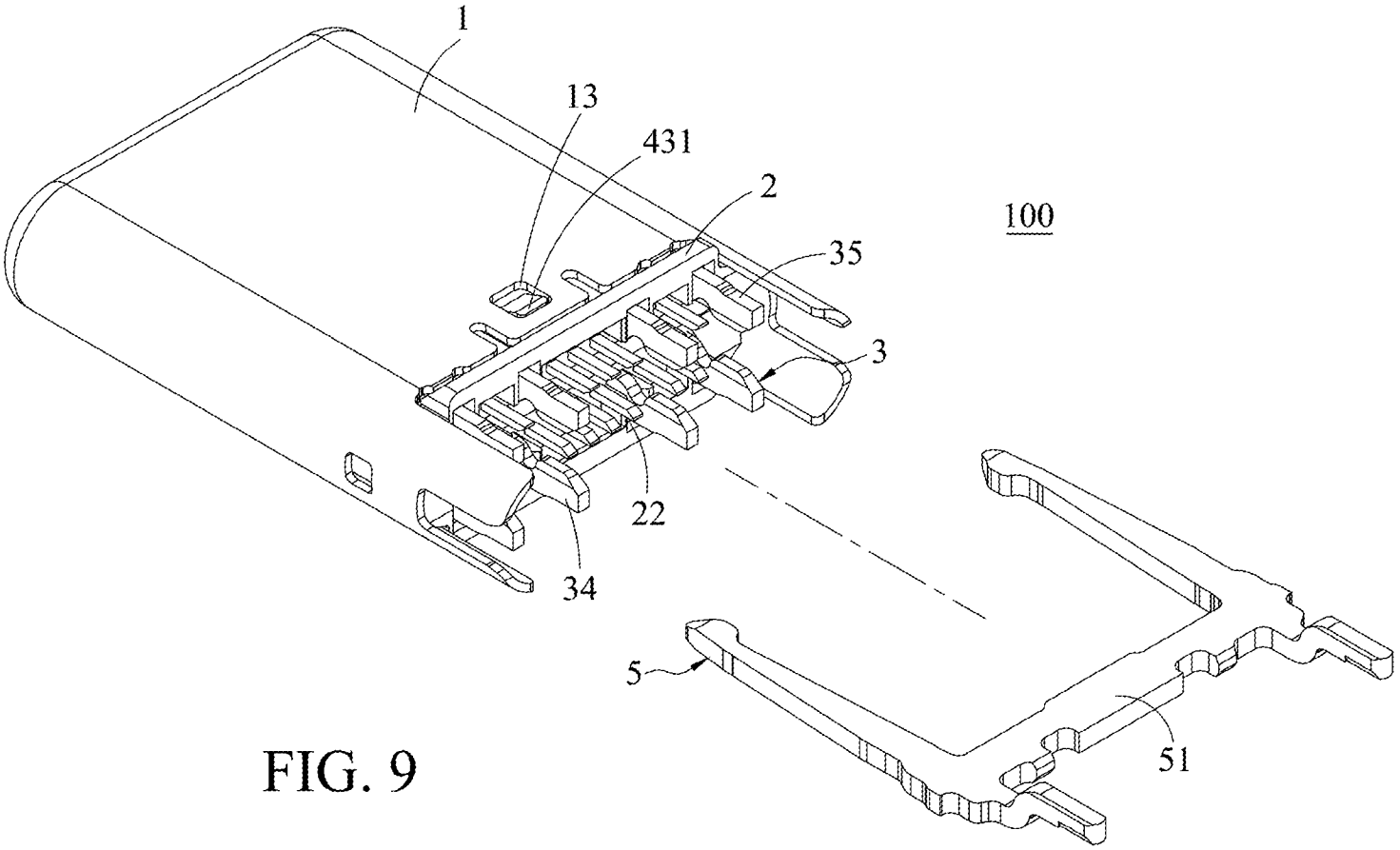
FIG. 9 illustrates an assembled perspective view (2) of the electrical plug connector of some exemplary embodiments.

Please refer to FIGS. 8 and 9. FIG. 8 illustrates an assembled perspective view (1) of an electrical plug connector 100 according to some exemplary embodiments of the instant disclosure. FIG. 9 illustrates an assembled perspective view (2) of the electrical plug connector 100 of some exemplary embodiments. In this embodiment, the assembling process may be, but not limited to, firstly the power terminal group 3 is assembled in the terminal grooves 22, and then the signal terminal group 4 is inserted into the terminal grooves 22, and last, the hook portions 5 are inserted into the two sides of the insulated housing 2, but embodiments are not limited thereto. In some embodiments, the assembling process may be, firstly the signal terminal group 4 is assembled in the terminal grooves 22, and then the power terminal group 3 is assembled in the terminal groove 22, and last, the hook portions 5 are inserted into the two sides of the insulated housing 2.

In this embodiment, more specifically, the metallic shell 1 is a hollowed shell, and the metallic shell 1 has a receiving cavity. The metallic shell 1 may be a unitary member or may be formed by several pieces. Moreover, one side of the metallic shell 1 has a connection opening in tubular or rectangular shaped, and the connection opening is in communication with the receiving cavity.

In this embodiment, more specifically, the insulated housing 2 is formed by a base portion, a tubular structure, the insertion cavity 21, and an assembling groove. In this embodiment, the base portion, the tubular structure, the insertion cavity 21, and the assembling groove are formed by injection molding. Moreover, a first plate and a second plate are respectively formed at the upper portion and the lower portion of the tubular structure. The tubular structure extends from one of two ends of the base portion, and the assembling groove is formed at the other end of the base portion; namely, in this embodiment, the other end of the base portion has the assembling groove in U-shape.

In this embodiment, more specifically, the base portion of the insulated housing 2 comprises the terminal grooves 22, and the terminal grooves 22 are defined through the inner wall of the assembling groove. The terminal grooves 22 are in communication with the insertion cavity 21. The terminal grooves 22 are provided for being inserted by the terminals. Moreover, the insertion cavity 21 is between the first plate and the second plate of the tubular structure.

Please refer to FIGS. 1 and 2. FIG. 1 illustrates a perspective view of the electrical plug connector 100 of the first embodiment, and FIG. 2 illustrates an exploded view of the electrical plug connector 100 of the first embodiment. The power terminal group 3 has a plurality of first contact portions 31 and a plurality of second contact portions 32, and the first contact portions 31 and the second contact portions 32 are elastic. The positioning plate 33 is held on the base portion of the insulated housing 2. The width of the positioning plate 33 is greater than the width of the first contact portion 31 or is greater than the width of the second contact portion 32. The first contact portion 31 and the second contact portion 32 of each of the terminals of the power terminal group 3 are aimed at the corresponding terminal groove 22 and inserted into the insertion cavity 21, and the front end of the positioning plate 33 of each of the terminals of the power terminal group 3 can be abutted against the inner wall of the corresponding terminal groove 22 (that is, in this embodiment, the front end of the positioning plate 33 of each of the terminals of the power terminal group 3 can be abutted against the stopping block 23 at the inner wall of the corresponding terminal groove 22).

The first contact portion 31 and the second contact portion 32 respectively extend toward the insertion cavity 21 from the upper portion and the lower portion of the positioning plate 33. The front end of the first contact portion 31 and the front end of the second contact portion 32 are provided for being in contact with terminals of an electrical receptacle connector. The first contact portion 31, the second contact portion 32, and the positioning plate 33 are formed as a clamp structure. That is, in this embodiment, from a lateral view, the first contact portion 31, the second contact portion 32, and the positioning plate 33 are formed as a C-shape structure, for example, a harpoon like structure. Moreover, in this embodiment, the first contact portion 31 and the second contact portion 32 respectively extend from the upper portion and the lower portion of the positioning plate 33 and are respectively at the lower surface of the first plate and the upper surface of the second plate. That is, in this embodiment, the first contact portions 31 and the second contact portions 32 are formed as upper-row terminals and lower-row terminals in the insertion cavity 21.

The front portion of the first contact portion 31 and the front portion of the second contact portion 32 are arranged symmetrically with respect to each other and are arranged to be tilted toward each other. The width of the clamping region between the first contact portion 31 and the second contact portion 32 gradually reduces from the inner portion of the clamp structure toward the opening of the clamp structure. When the electrical plug connector 100 is mated with an electrical receptacle connector, the upper surface and the lower surface of the tongue portion of the electrical receptacle connector firstly contact the curved surface connected between the first contact portion 31 and the second contact portion 32. Accordingly, due to the tilted configuration, the first contact portion 31 and the second contact portion 32 have an enhanced holding force. That is, in this embodiment, due to the tilted configuration of the first contact portion 31 and the second contact portion 32, the distance between the first contact portion 31 and the second contact portion 32 is less than the width of the tongue portion. Hence, when the tongue portion is inserted between the first contact portion 31 and the second contact portion to push away the first contact portion 31 and the second contact portion 32, the first contact portion 31 and the second contact portion 32 are bounced resiliently to enhance the holding force for clamping the tongue portion.

In this embodiment, from a front view of the terminals of the power terminal group 3 (as shown in FIG. 7), the terminals of the power terminal group 3 comprise, from right to left, a first ground terminal (Gnd), a first power terminal (Power/VBUS), a second power terminal (Power/VBUS), and a second ground terminal (Gnd).

The electrical plug connector 100 further comprises a plurality of hook portions 5. The hook portions 5 are at two sides of the insulated housing 2. The hook portions 5 may be combined with the insulated housing 2 by following ways. The insulated housing 2 may be combined with the hook portions 5 by insert-molding, or the insulated housing 2 and the hook portions 5 may be combined with each other by assembling. Specifically, in some embodiments, two sides of the insulated housing 2 comprise through grooves, and the hook portions 5 are assembled into the through grooves. The hook portion 5 is mainly formed by a plurality of protruding hooks and a plurality of protruding contacts.

The protruding hooks are positioned at two sides of the insulated housing 2, and the protruding hooks are in contact with the inner wall of the metallic shell 1. The protruding contacts extend from the front portions of the protruding hooks and extend into two sides of the insertion cavity 21. When the electrical plug connector 100 is mated with the electrical receptacle connector, the buckling pieces at two sides of the electrical receptacle connector are in contact with the protruding contacts. Accordingly, the positioning, the conduction, and the grounding of the electrical plug connector 100 in the electrical receptacle connector can be accomplished by the contact between the outer portions of the protruding hooks and the metallic shell 1.

In this embodiment, the signal terminal group 4 has sixteen terminals arranged into upper and lower rows for USB 3.0 signal transmission (high-speed signal transmission). The pin assignment of the terminals of the signal terminal group 4 corresponds to the first contact portion 31 and the second contact portion 32 arranged into the upper-row terminals and the lower-row terminals of the power terminal group 3. From a front view of the terminals of the signal terminal group 4 (as shown in FIG. 7), the upper-row terminals of the signal terminal group 4 comprises, from right to left, a first pair of first high-speed signal terminals 41 (TX1+−, differential signal terminals), a first function detection terminal (CC1, a terminal for inserting orientation detection of the connector and for cable recognition), a pair of first low-speed signal terminals 42 (D+−, differential signal terminals), a first reserved terminal (RFU), and a second pair of first high-speed signal terminals 41 (RX2+−, differential signal terminals). The lower-row terminals of the signal terminal group 4 comprises, from left to right, a first pair of second high-speed signal terminals 41 (TX2+−, differential signal terminals), a second function detection terminal (CC2, a terminal for inserting orientation detection of the connector and for cable recognition), a pair of second low-speed signal terminals 42 (D+−, differential signal terminals), a second reserved terminal (RFU), and a second pair of second high-speed signal terminals 41 (RX1+−, differential signal terminals).

In some embodiments, the signal terminal group 4 has eight terminals and the terminals may be arranged into a single row for USB 3.0 signal transmission (high-speed signal transmission). The terminals of the signal terminal group 4 are arranged into a single row, rather than being arranged as upper and lower rows. In these embodiments, from a front view of the terminals of the signal terminal group 4 (as the upper-row terminals of the signal terminal group 4 shown in FIG. 7), the upper-row terminals of the signal terminal group 4 comprises, from right to left, a first pair of high-speed signal terminals 41 (TX1+−, differential signal terminals), a reserved terminal (secondary bus, SBU2), a pair of low-speed signal terminals 42 (D+−, differential signal terminals), a detection terminal (VCON), and a second pair of high-speed signal terminals 41 (TX2+−, differential signal terminals).

In the embodiments mentioned above, the signal terminal group 4 has eight terminals for USB 3.0 signal transmission, but embodiments are not limited thereto. In some embodiments, the first pair of high-speed signal terminals 41 (TX1+−, differential signal terminals), the second pair of high-speed signal terminals 41 (TX2+−, differential signal terminals), and the reserved terminal (secondary bus, SBU2) may be omitted, and the rest terminals are retained for USB 2.0 signal transmission, thereby reducing the number of the terminals.

The power terminal group 3 and the signal terminal group 4 are arranged to meet the pin assignments of the USB type-C electrical plug connector. In this embodiment, pin-assignments of the first contact portions 31 and the second contact portions 32 are point-symmetrical with a central point of the receiving cavity as the symmetrical center. In other words, pin-assignments of the first contact portions 31 and the second contact portions 32 have 180-degree symmetrical design with respect to the central point of the receiving cavity as the symmetrical center. The dual or double orientation design enables the electrical plug connector 100 to be inserted into an electrical receptacle connector in either of two intuitive orientations, i.e., in either upside-up or upside-down directions. Here, point-symmetry means that after the first contact portions 31 (or the second contact portions 32), are rotated by 180 degrees with the symmetrical center as the rotating center, the first contact portions 31 and the second contact portions 32 are overlapped. That is, the rotated first contact portions 31 are arranged at the position of the original second contact portions 32, and the rotated second contact portions 32 are arranged at the position of the original first contact portions 31.

Figure 12:
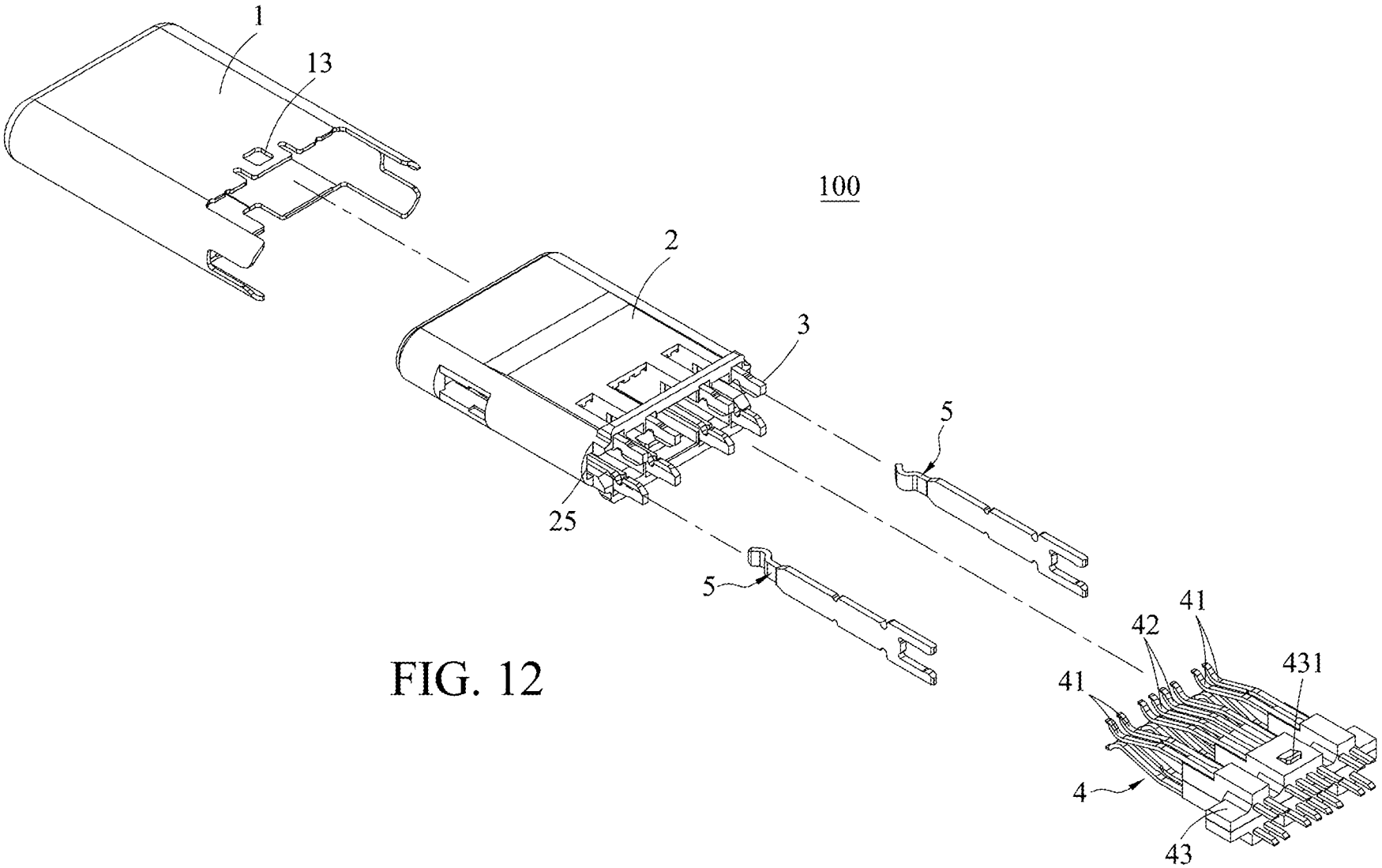
FIG. 12 illustrates an exploded view of an electrical plug connector according to a second embodiment of the instant disclosure.
Figure 13:
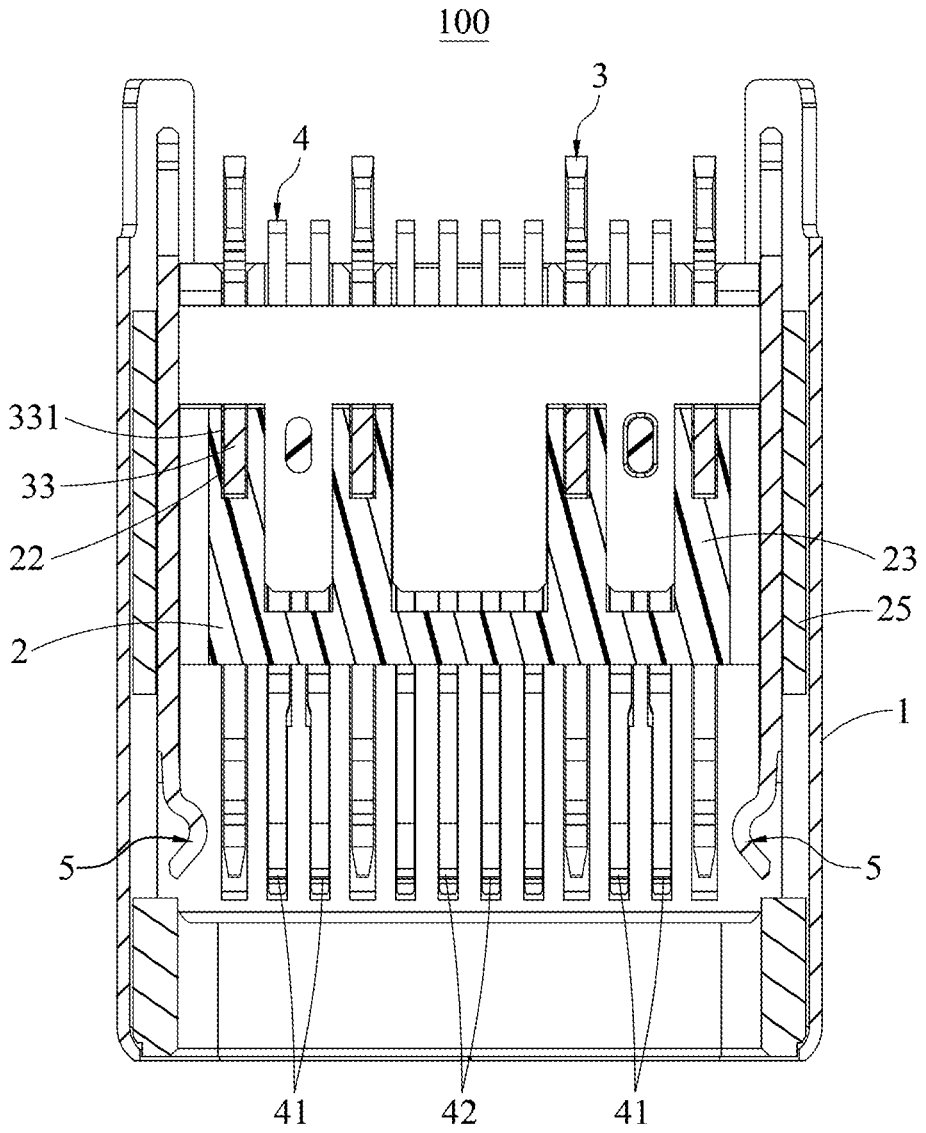
FIG. 13 illustrates a top sectional view of the electrical plug connector of the second embodiment.

Please refer to FIGS. 12 and 13. An electrical plug connector 100 according to a second embodiment of the instant disclosure is illustrated. FIG. 12 illustrates an exploded view of the electrical plug connector 100 of the second embodiment. FIG. 13 illustrates a top sectional view of the electrical plug connector 100 of the second embodiment. In this embodiment, the hook portions 5 are bent-type hooks, and the hook portions 5 are at two sides of the insulated housing 2 and extend into the insertion cavity 21.

According to one or some embodiments of the instant disclosure, the terminals of the power terminal group and the terminals of the signal terminal group are formed as terminals in different types. The power terminal group and the signal terminal group are provided in the same electrical plug connector, such that the electrical plug connector is applicable for transmitting a current having 6 Amps or more and meets the Gen2 specification.

The thicknesses for different portions of the terminal of the signal terminal group are approximately the same, thereby being suitable for high-speed signal transmission and high frequency characteristics adjustment. The thicknesses for different portions of the terminal of the power terminal group are not the same, and the thickness of the terminal of power terminal group is gradually reduced (the terminal of the power terminal group may have a wider thickness for the second tail portion but have a reduced width for the second contact portion, but embodiments are not limited thereto). The signal terminal group uses the bent-type terminals for meeting the Gen2 specification, and the signal terminal group is served as terminals for signal transmission. The power terminal group uses the blanking-type terminals, and the power terminal group is served as terminals for power transmission. The cross-sectional area of the blanking-type terminal is greater than the cross-sectional area of the bent-type terminal thereby suitable for transmitting a current having 6 Amps or more. The blanking-type terminal has a greater charging speed as compared with the charging speed of the bent-type terminal.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical plug connector, comprising:

a metallic shell;

an insulated housing in the metallic shell, wherein one of two ends of the insulated housing comprises an insertion cavity, and the other end of the insulated housing comprises a plurality of terminal grooves communicating with the insertion cavity;

a power terminal group in the terminal grooves, wherein each of terminals of the power terminal group comprises a first contact portion, a second contact portion, and a positioning plate, wherein the first contact portion, the second contact portion, and the positioning plate are formed as a clamp structure, the first contact portion extends from an upper portion of the positioning plate and is above the insertion cavity, the second contact portion extends from a lower portion of the positioning plate and is below the insertion cavity, each of the terminals of the power terminal group comprises a contact point at one side of the positioning plate, and the contact point is in contact with an inner wall of the corresponding terminal groove;

a signal terminal group in the terminal grooves, wherein each of terminals of the signal terminal group is arranged with the corresponding terminal of the power terminal group side-by-side, wherein a cross-sectional area of each of the terminals of the signal terminal group is less than a cross-sectional area of the corresponding terminal of the power terminal group; and a positioning block, wherein the positioning block is assembled with the signal terminal group, and the positioning block is abutted against a rear portion of the positioning plate of one of the terminals of the power terminal group.

2. The electrical plug connector according to claim 1, wherein each of the terminals of the power terminal group is a blanking-type terminal, and each of the terminals of the signal terminal group is a bent-type terminal.

3. The electrical plug connector according to claim 2, wherein each of the terminals of the power terminal group comprises a plurality of the contact points at two sides of the positioning plate, and each of the contact points is in contact with the inner wall of the corresponding terminal groove.

4. The electrical plug connector according to claim 2, wherein each of the terminals of the power terminal group comprises a first tail portion and a second tail portion, the first tail portion extends out of the corresponding terminal groove from the upper portion of the positioning plate, and the second tail portion extends out of the corresponding terminal groove from the lower portion of the positioning plate.

5. The electrical plug connector according to claim 2, wherein the insulated housing comprises stopping blocks respectively formed in the terminal grooves, and each of the stopping blocks is between the first contact portion and the second contact portion of the corresponding terminal of the power terminal group.

6. The electrical plug connector according to claim 2, further comprising a positioning block, wherein the positioning block is assembled with the signal terminal group, and the positioning block is abutted against a rear portion of the positioning plate of one of the terminals of the power terminal group.

7. The electrical plug connector according to claim 6, wherein an engaging block protrudes from the positioning block, and the engaging block is engaged with an inner side of the insulated housing.

8. The electrical plug connector according to claim 2, further comprising a plurality of hook portions at two sides of the insulated housing and extending into the insertion cavity, wherein the hook portion is a blanking-type hook or a bent-type hook.

9. The electrical plug connector according to claim 8, wherein the hook portions comprise blanking-type hooks, and a lateral arm is between the blanking-type hooks.

10. The electrical plug connector according to claim 2, wherein the terminals of the signal terminal group are arranged into two rows, the signal terminal group comprises a plurality of high-speed signal terminals and a plurality of low-speed signal terminals.

11. The electrical plug connector according to claim 1, wherein each of the terminals of the power terminal group comprises a plurality of the contact points at two sides of the positioning plate, and each of the contact points is in contact with the inner wall of the corresponding terminal groove.

12. The electrical plug connector according to claim 1, wherein each of the terminals of the power terminal group comprises a first tail portion and a second tail portion, the first tail portion extends out of the corresponding terminal groove from the upper portion of the positioning plate, and the second tail portion extends out of the corresponding terminal groove from the lower portion of the positioning plate.

13. The electrical plug connector according to claim 1, wherein the insulated housing comprises stopping blocks respectively formed in the terminal grooves, and each of the stopping blocks is between the first contact portion and the second contact portion of the corresponding terminal of the power terminal group.

14. The electrical plug connector according to claim 1, wherein an engaging block protrudes from the positioning block, and the engaging block is engaged with an inner side of the insulated housing.

15. The electrical plug connector according to claim 1, further comprising a plurality of hook portions at two sides of the insulated housing and extending into the insertion cavity, wherein the hook portion is a blanking-type hook or a bent-type hook.

16. The electrical plug connector according to claim 15, wherein the hook portions comprise blanking-type hooks, and a lateral arm is between the blanking-type hooks.

17. The electrical plug connector according to claim 1, wherein the terminals of the signal terminal group are arranged into two rows, the signal terminal group comprises a plurality of high-speed signal terminals and a plurality of low-speed signal terminals.

18. An electrical plug connector, comprising:

a metallic shell;

an insulated housing in the metallic shell, wherein one of two ends of the insulated housing comprises an insertion cavity, and the other end of the insulated housing comprises a plurality of terminal grooves communicating with the insertion cavity;

a power terminal group in the terminal grooves, wherein each terminal of the power terminal group comprises a first contact portion, a second contact portion, and a positioning plate, wherein the first contact portion, the second contact portion, and the positioning plate are formed as a clamp structure, the first contact portion extends from an upper portion of the positioning plate and is above the insertion cavity, the second contact portion extends from a lower portion of the positioning plate and is below the insertion cavity, each of the terminals of the power terminal group comprises a contact point at one side of the positioning plate, and the contact point is in contact with an inner wall of the corresponding terminal groove; and a signal terminal group in the terminal grooves, wherein each terminal of the signal terminal group is arranged with the corresponding terminal of the power terminal group side-by-side, wherein a cross-sectional area of each of the terminals of the signal terminal group is less than a cross-sectional area of the corresponding terminal of the power terminal group, wherein each of the terminals of the power terminal group comprises a plurality of the contact points at two sides of the positioning plate, and each of the contact points is in contact with the inner wall of the corresponding terminal groove.

* * * * *